US008074664B2

(12) United States Patent
Ruckdeschel

(10) Patent No.: US 8,074,664 B2
(45) Date of Patent: Dec. 13, 2011

(54) HAIR DEVICE AND METHOD FOR FORMING AND HOLDING HAIR

(76) Inventor: Elizabeth Ann Ruckdeschel, Los Angeles, CA (US)

( * ) Notice: Subject to any disclaimer, the term of this patent is extended or adjusted under 35 U.S.C. 154(b) by 324 days.

(21) Appl. No.: 12/271,508

(22) Filed: Nov. 14, 2008

(65) Prior Publication Data

US 2010/0012138 A1 Jan. 21, 2010

Related U.S. Application Data

(60) Provisional application No. 61/080,994, filed on Jul. 15, 2008.

(51) Int. Cl.
*A45D 8/12* (2006.01)
*A45D 8/00* (2006.01)
*A45D 7/00* (2006.01)

(52) U.S. Cl. ..... 132/275; 132/273; 132/200

(58) Field of Classification Search ..... 132/273, 132/275, 274, 270, 212, 54; 2/174
See application file for complete search history.

(56) References Cited

U.S. PATENT DOCUMENTS 2,211,184 A * 8/1940 Varell ..... 2/174
3,101,724 A * 8/1963 Nizetich ..... 132/270
3,126,015 A * 3/1964 Sidelman ..... 132/210
3,126,017 A * 3/1964 Sidelman ..... 132/54
3,126,019 A 3/1964 Sidelman
3,327,720 A * 6/1967 Carmony et al. ..... 132/274
3,392,737 A * 7/1968 Fefferman ..... 132/274
3,561,455 A * 2/1971 Gregg ..... 132/274
3,610,257 A * 10/1971 Hall ..... 132/270
3,640,289 A * 2/1972 Sbarra ..... 132/212
3,968,805 A * 7/1976 Sobeck, Jr. ..... 132/270
4,259,972 A 4/1981 Spaccapaniccia
4,267,850 A * 5/1981 Barrett ..... 132/270
5,472,003 A * 12/1995 Frame et al. ..... 132/275
5,845,657 A 12/1998 Carberry et al.
6,276,368 B1 8/2001 Giamalva
2005/0247327 A1* 11/2005 Ison ..... 132/274
2006/0174907 A1 8/2006 Morris et al.
2008/0202547 A1* 8/2008 Blye ..... 132/270

* cited by examiner

*Primary Examiner* — Robyn Doan

(74) *Attorney, Agent, or Firm* — Berenato & White, LLC

(57) ABSTRACT

A hair device comprising a cone shaped form with a defined narrow neck near the top that curves in where an elastic band can be wrapped around to secure the hair in place. The hair conceals the device from all angles of the head and gives the impression of the hair standing on end without styling products. There are various decorative attachments that can be attached at the opening in the top or stuck into the holes on the body of the device to pin up loose hair and/or add styling flair.

9 Claims, 4 Drawing Sheets

HAIR DEVICE AND METHOD FOR FORMING AND HOLDING HAIR

CROSS-REFERENCE TO RELATED APPLICATIONS

This application claims the benefit of provisional application, Ser. No. 61/080,994, filed on Jul. 15, 2008.

BACKGROUND OF THE INVENTION

1. Field of the Invention

This invention relates generally to a hair device and method for forming and holding hair on end in a decorated cone shape.

2. Background

Currently there are a number of solutions for decorative adornment of hair. Some of these solutions attempt to increase volume, hold, shape and extend hair in a raised hair up-do, but these solutions fail to meet the needs of the industry because the hair style achieved by existing devices creates an ordinary up hair-do or a beehive style, but does not offer maximum volume and height by using the entire head of hair at its full extended length. Additionally, there are more accessory variation and embellishment attachment options to be inserted all over the head of hair once styled. Other solutions attempt to lift, guide and hold hair up with a hair foundation through various molded comb and bristle brush methods, but these solutions are similarly unable to meet the needs of the industry because they are tubular in shape, not as easy to secure, require bristle brushes to hold locks of hair (not the full head) and don't result in the same sculpted, hourglass shape style. Still other solutions seek to hold a hair raising device on a user's head without hair pins and accommodate for a range of hair lengths, but these solutions also fail to meet industry needs because they work with foundations with holes over the body of the device that shape small sections of the hair to create a beehive-like style, which does not engage the entire head of hair or extend all the hair off the scalp to it's maximum vertical height based on the length of the user's hair.

Therefore, it would be desirable to have a hair device and method for forming and holding hair on end in a decorated cone shape where the hair conceals the device and gives the impression that the hair is standing on end without styling products or hair pins. It would further be desirable to have a device that can be used to create a unique hair style. Still further, it would be desirable to have a device that provides the option of adding decorative adornments that can be worn as a hair style for festive events, seasonal occasions, costume parties or to enhance individual fashion and personal style.

SUMMARY OF THE INVENTION

The present invention advantageously fills the aforementioned deficiencies by providing a hair device and method for forming and holding hair on end in a decorated cone shape where the hair conceals the device and gives the impression that the hair is standing on end without styling products.

The present invention provides an hourglass shape including holes that receive adornments. There are three kinds of accessory attachments that can be used with the present invention and these include: (1) accessories that attach at the top of the device through an opening that can be secured with a plug; (2) accessories that can be shapeable, bendable, or any other object extensions that protrude off the surface of the devices and which snap into the body of the device, attaching into holes found on the contoured body of the device; and (3) accessories that are snap-in plugs that help hold fly-away strands of hair in place while adding decorative value. Also included in the present invention is a method of using the device to create a unique hair style.

By flipping your head upside down and placing the device, the plastic or rubber cone shaped form, on the crown of the head and wrapping the entire head of hair around the foundation to conceal the form completely beneath the hair, the hair is then bundled at the top and secured at the narrow neck with an elastic rubber band and hence can exert a force, keeping the hair standing on end effortlessly in a vertical cone shape, allowing the entire head of hair to extend straight up from the scalp. The device comes in various sizes to accommodate different hair lengths and in different colors to match the spectrum of natural hair colors. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
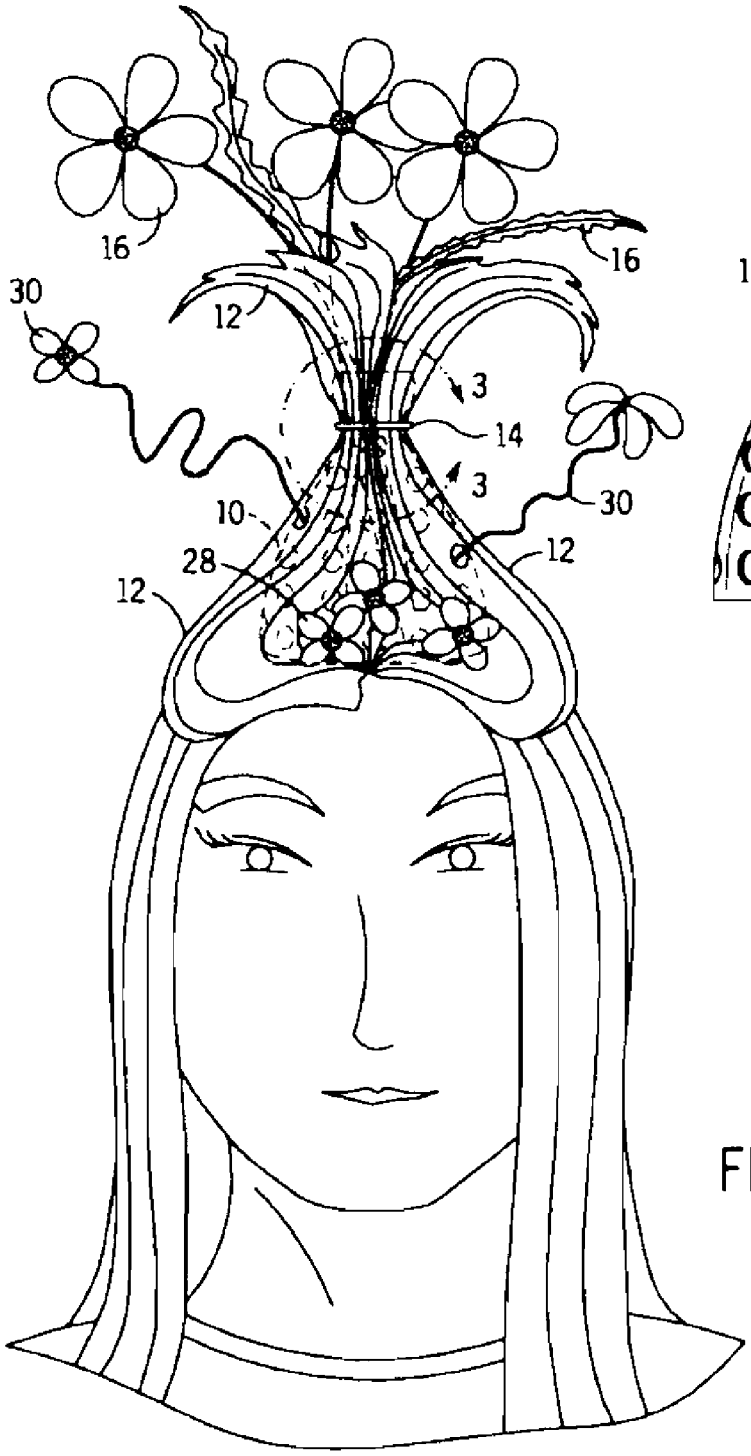
FIG. 1 is a front elevation view of the invention in use.

The present invention is directed to a hair device and method for forming and holding hair on end in a decorated cone shape. The Figures make reference to the following:

Shown in FIG. 1 is a particular shaping device of the present invention 10, shown here in use. The device 10 sits on the top portion of the head of the user and a portion of the hair of the user 12 is pulled up over the device and secured to hide the device from view, thereby concealing the device 10 from all angles and giving the impression that the hair is standing on end. The hair device 10 shown in FIGS. 1 and 2 possess a cone shaped form 18, the form having a defined narrow neck 20 near the top that curves in where an elastic band 14 can be wrapped around to secure the hair in place. While the device 10 is shown to have a cone shaped form 18, it should be noted that various other upright shapes can be used. Additionally, it should be noted that the device 10 may come in different sizes designed for different hair lengths and different head sizes and shapes, such as, but not limited to mound, pyramid and square shapes. Indeed, the device 10 can come in different colors appropriate for use with different hair shades and tones, for example blondes, redheads, light brown hair, dark brunette or black hair. Matching the color value of the hair to the color of the device makes it easier to conceal the device by minimizing the color contrast between the device and the hair.

Figure 2:
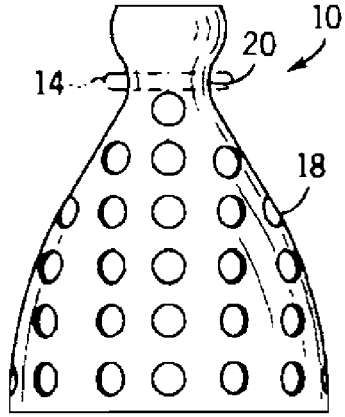
FIG. 2 is a front elevation view of the invention.

FIG. 2 shows the present invention 10 in a front elevation, but not in use. This illustration particularly demonstrates the neck down area 20 of the invention 10, and the elastic band 14, which can be wrapped around the conical shaped form 18 to hold the hair. It is most desired to place this elastic band around the neck area 20.

Figure 3:
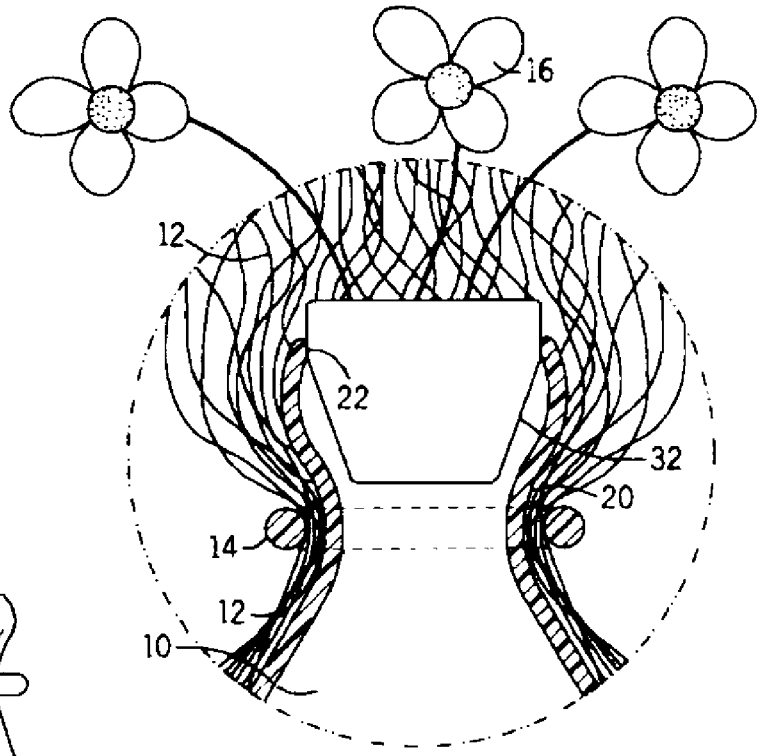
FIG. 3 is a detailed cross-sectional view, including plug-based attachment.

As shown best in FIG. 3, the device 10 has a rounded bubble top with an opening 22 where moveable and shapeable accessory attachments 16 can be inserted and secured by a plug system 32. The opening 22 has curved rounded edges, the first curved edge of the top being where the plug 32 is inserted to attach the accessory to the device, the second curved edge of the continuous form leads to the narrowest point, the neck 20, where the hair 12 gets secured to the device 10, which is preferably made of plastic. There are holes 26 on the body of the device where other decorative accessories 30 can be inserted for decorative value or to hold loose or shorter hair/layers in place. The holes give the user countless options for how to personalize the device, allowing them to use snap in plugs that fit into the holes and hold up loose hair that is too short to reach the rubber band at the neck of the device. It also helps the user shape and place hair in a stylized way around the body of the device. These attachments keep the secured in place, while adding stylistic value.

Figure 4:
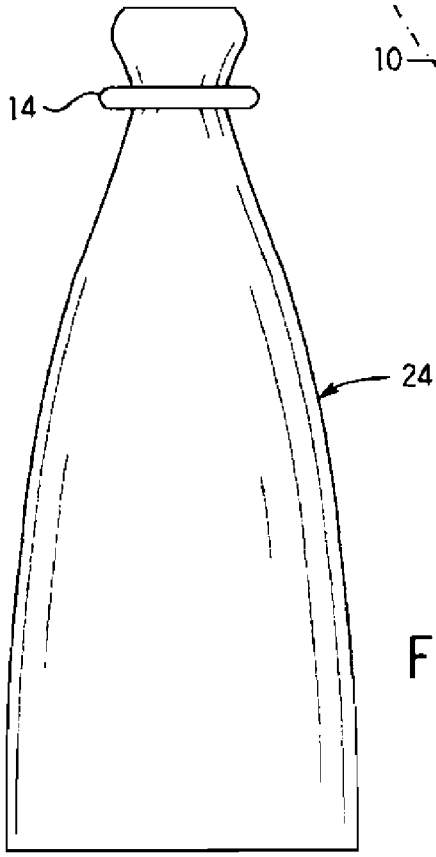
FIG. 4 is a front elevation view of a second embodiment of the invention.

Also shown in this figure is the hair of the user 12 being held close to the device 10 by an elastic band 14 secured around the neck area 20. The elastic band 14 is wrapped around the bundled hair 12 and thus, exerts a force to hold both the device and the hair in place securely. It should be noted, however, that while an elastic band is preferred it is possible to use other means to secure hair around the device 10, including but not limited to various tying devices. FIG. 4 demonstrates an alternative embodiment of the present invention 24 having a different conical shape than the embodiment of the device 10 previously shown.

Figure 5:
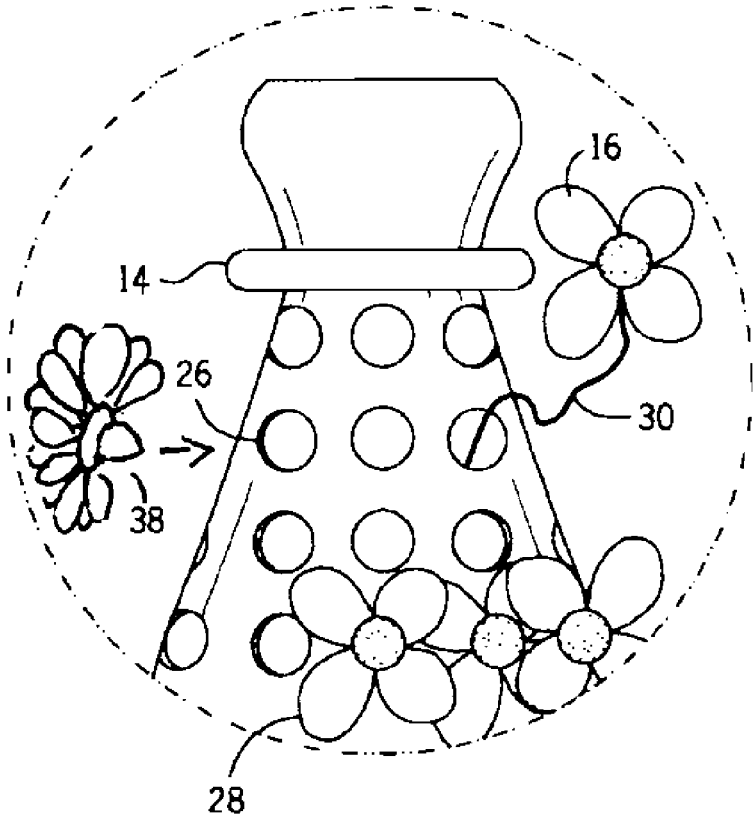
FIG. 5 is a detailed view of an alternate embodiment with holes and snap in or shapeable elements for insertion.
Figure 6:
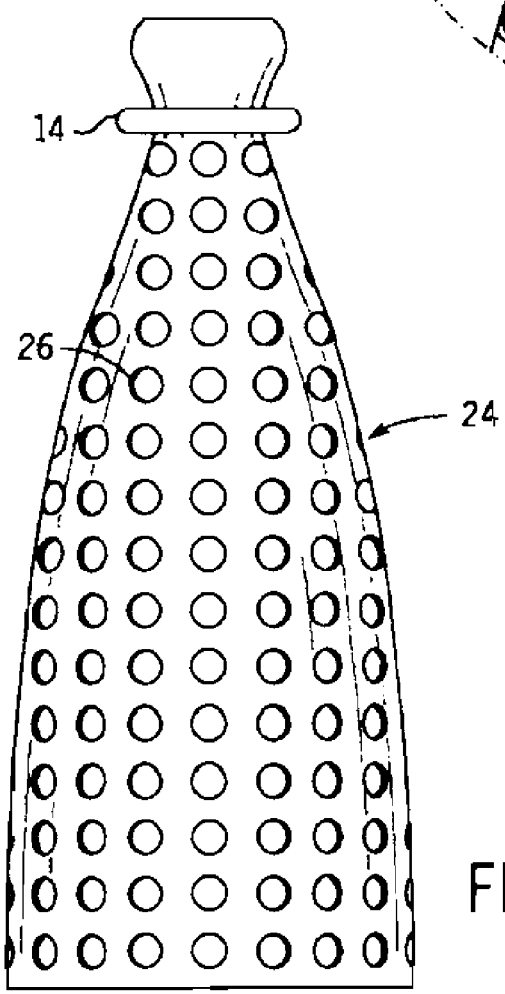
FIG. 6 is a front elevation view of the alternate embodiment with holes.

FIGS. 5 and 6 show the alternative embodiment of the device 24 having holes 26. In these holes 26 can be placed decorative accessories 30 having movable shapeable attachments 16 that are placed into the holes 26 snap into the holes. Also shown are decorative accessories 28, 38 that snap into or have an interference fit into the holes. These accessories can be made of soft plastic and/or foam rubber so as to deformably engage the edges of holes 26 and be retained thereby.

Figure 7:
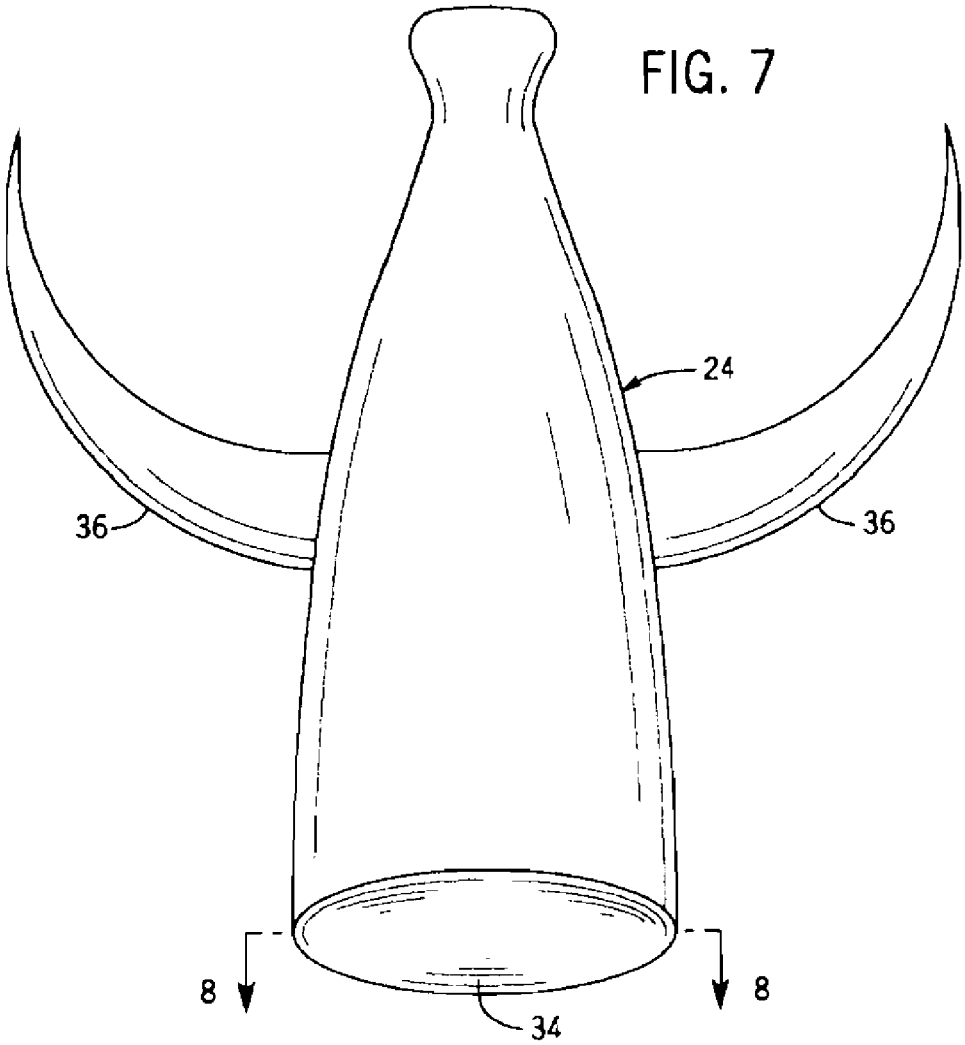
FIG. 7 is an elevational view of an alternative embodiment of the invention.

FIG. 7 finally shows yet another variation to the alternative embodiment 24, this time having a molded, protruding adornment 36. This adornment 36 can be built into the physical form of the device 24, or can be attached to the device 24 by attaching or snapping into holes (not shown). Protruding adornments 36 can include horns, molded antlers, wings or any other object extending from the device concealed beneath the head of hair.

Figure 8:
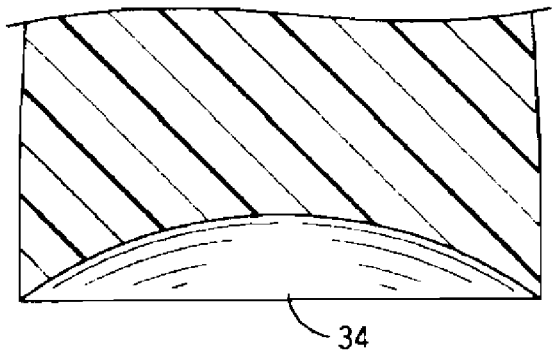
FIG. 8 shows, in cross section, the contoured, molded base.

Also shown in FIG. 7 (and FIG. 8 in cross-section) is the contoured, molded base 34 of the alternate embodiment 24. This contoured, molded base 34 can also be a part of the previously shown device 10. The base 34 is contoured to fit the scalp closely and comfortably. It is a molded head shaped form that rests in place and keeps the device from slipping or falling off the head once the rubber band is secured in place.

Decorative accessories of any kind can be attached to embellish the device 10 for a festive event, seasonal occasion, costume or theme, and can be mounted on a plug 32 which can be inserted into the hole at the top of the cone shaped device 10 or 24. The accessories, or decorative attachments, may further include plastic, paper, felt, silk, metal wire or adornments of other materials secured thereto. Celebratory accessories can be used for any occasion. For example, a party accessory for New Years Eve, such as a cardboard sign with Happy New Years, or a Happy Birthday attachment for to wear at birthday party, or a Happy St. Patrick's Day sign, perhaps shaped as a shamrock.

Accessory attachments are also made to embellish costumes that incorporate the cone shape 18. For example, for a Christmas tree head, the hair is sprayed green and decorated with ball ornaments and lights to look like a Christmas tree and then, it is topped with a star or an angel shaped accessory. Another attachment is personalized name plates so individuals can top off their look with their own name. Similarly, for sports fans, team colors and pendants can be placed in the device. A popular usage of the device and its attachments is for Halloween costumes or extreme hairstyles, impersonate personalities ranging from Marge Simpson to Bride of Frankenstein to Amy Winehouse. Other attachments will include flexible, movable parts like a bug's antennae that allow you to bend and shape your hair around the moveable parts.

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A hair shaping device for supporting styled hair fully extended in an upright direction off a user's scalp, comprising:

a body portion having a base portion for resting on the scalp and underlying hair, a top portion, and a mid-portion connecting between said base and top portions, said mid-portion including a necked down shape narrower in diameter than either said base or top portion so to enable reliable entrapment of hair via an elastic surround around said necked down shape so as to hold said hair against and conceal an outside surface of said body portion, wherein said mid-portion and top portion are hollow and include a plurality of holes there through for accepting strands of hair and decorative inserts for decoration and holding said strands in place at their extended length; and, said top portion includes a centrally located opening and an insertable, retainable, plug for retaining hair strands against said opening and for accepting decorative inserts into said plug.

2. A hair shaping device as in claim 1, further comprising:

a molded insert for association with said base, said molded insert being shaped to outwardly engage an inner surface of said lower body portion and, oppositely thereto, having a shaped scalp engaging exterior for assuring a user's comfort and further securing the device on a users head when said device is worn.

3. A hair shaping device as in claim 1, wherein:

said decorative inserts are molded as, for example, animal horn replicas.

4. A method of creating a hair shape wherein at least a portion of a person's hair is fully extended from the person's head in an upward direction, comprising the steps of:

selecting an appropriately tall hair shaping device including a body portion having a base portion for resting on the scalp and underlying hair, a top portion, and a mid-portion connecting between said base and top portions, said mid-portion including a necked down shape narrower in diameter than either said base or top portion;

placing said hair shaping device atop a person's scalp on a top portion of their scalp;

gathering hair strands extending from beneath said device and, lifting them upwardly, securing said strands against sides of said device using an elastic surround to hold said hair strands against said necked down shape of said mid portion;

concealing said device using said hair strands, wherein said hair shaping device further includes holes in said body thereof, and said method further includes the step of inserting decorative retainers of hair strands into said holes, and, wherein said hair shaping device further includes a centrally positioned passageway in said top portion and a complimentary plug, and said method further includes the step of inserting said plug into said passageway.

5. A hair shaping device for supporting styled hair fully extended in an upright direction off a user's scalp, comprising:

a one-piece cone shaped hollow body portion of fixed dimension, made of resilient material having sufficient strength to hold hair in an upright fully extended configuration, said body portion having a base portion for resting on the scalp and underlying hair, a top portion, and a mid-portion connecting between said base and top portions, said mid-portion including a necked down shape narrower in diameter than either said base or top portion creating a top to base hour glass overall shape to said cone shaped body portion, said necked shape enabling reliable positional entrapment of a user's hair via an elastic surround around said necked down mid-portion so as to hold said hair against and conceal an outside surface of said body portion, said base portion having a larger overall diameter than said top portion, said mid-portion and top portion are hollow and include a plurality of holes there through for accepting strands of hair and decorative inserts for decoration and holding said strands in place at their extended length; and, said top portion includes a centrally located opening and an insertable, retainable, plug for retaining hair strands against said opening and for accepting decorative inserts into said plug.

6. A hair shaping device as in claim 5, further comprising:

a molded insert for association with said base, said molded insert being shaped to outwardly engage and affix to said lower body portion and, oppositely thereto, having a shaped scalp engaging inwardly concave exterior for assuring a user's comfort and further securing the device on a users head when said device is worn.

7. A hair shaping device as in claim 5, wherein:

said decorative inserts are molded as, for example, animal horn replicas.

8. A method of creating a hair shape wherein at least a portion of a person's hair is fully extended from the person's head in an upward direction, comprising the steps of:

selecting an appropriately tall hair shaping device including a one-piece cone shaped fixed dimension body portion, comprised of resilient material, having a base portion for resting on the scalp and underlying hair, a top portion, and a mid-portion connecting between said base and top portions, said mid-portion including a necked down shape narrower in diameter than either said base or top portion creating a top to base hour glass overall shape to said cone shaped body portion, said base portion having a larger overall diameter than said top portion;

placing said hair shaping device base onto a person's scalp on a top portion of their scalp;

gathering hair strands extending from beneath said device and, lifting them on all sides thereof upwardly, securing said strands against sides of said device using an elastic surround to hold said hair strands in position against said necked down shape of said mid portion;

concealing said device using said hair strands; and, wherein said hair shaping device further includes a centrally positioned passageway in said top portion and a complimentary plug, and said method further includes the step of inserting said plug into said passageway.

9. A method as in claim 8, wherein:

said hair shaping device further includes holes in said body thereof, and said method further includes the step of inserting decorative retainers of hair strands into said holes.

* * * * *